US006152839A

United States Patent [19]

Heyduk

[11] Patent Number: 6,152,839

[45] Date of Patent: Nov. 28, 2000

[54] HOCKEY STICK BLADE ASSEMBLY

[76] Inventor: Henry Heyduk, 2938 Rainwater Drive, Mississauga, Canada, L5N 6K8

[21] Appl. No.: 09/030,021

[22] Filed: Feb. 25, 1998

Related U.S. Application Data

[63] Continuation-in-part of application No. 08/848,875, May 1, 1997, abandoned.

[51] Int. Cl.[7] ..... A63B 59/14

[52] U.S. Cl. ..... 473/562

[58] Field of Search ..... 473/560–563

[56] References Cited

U.S. PATENT DOCUMENTS

| | | | |
|---|---|---|---|
| 3,934,875 | 1/1976 | Easton et al. | 473/561 |
| 5,582,406 | 12/1996 | Babcock | 473/562 |
| 5,628,509 | 5/1997 | Christian | 473/562 |

FOREIGN PATENT DOCUMENTS

| | | | |
|---|---|---|---|
| 3012300 | 10/1981 | Germany | 473/FOR 189 |

*Primary Examiner*—Mark S. Graham

[57] ABSTRACT

A hockey stick blade assembly for removable and replaceable installation onto a reusable hockey stick shaft comprises a blade member having a bottom blade portion and an upwardly extending hozel portion insertable into the hollow end of the hockey stick shaft. First and second co-operating wedging surfaces are operatively disposed on the hozel portion of the blade member and on a wedge member, respectively, and are shaped for wedging contact with each other. When the hozel portion of the blade member engages the hockey stick shaft, the first wedging surface imparts a substantially transverse first wedging force to the second wedging surface and the second wedging surface imparts an oppositely directed substantially transverse second wedging force to the first wedging surface, which wedging forces are transmitted to the outer walls of the hollow-ended hockey stick shaft. The outer walls deform slightly to absorb the opposed first and second wedging forces and thus impart corresponding inwardly directed opposed reaction forces against the first and second wedging surfaces, thereby forcing the first and second wedging surfaces into intimate frictional engagement one with the other, so as to retain the blade member in place on the hockey stick shaft. A locking means is securely engageable between the blade member and the wedge member to preclude relative movement along a common longitudinal axis of the blade member and hockey stick shaft with respect to each other when the blade member is installed on the shaft.

9 Claims, 4 Drawing Sheets

HOCKEY STICK BLADE ASSEMBLY

CROSS-REFERENCE

This application is a Continuation-In-Part (CIP) application of Ser. No. 08/848,875 filed May 1, 1997—now abandoned.

FIELD OF THE INVENTION

This invention relates to hockey stick blade assemblies, and more particularly to a hockey stick blade assembly where the blade assembly is quickly and easily installed into and removed from the hollow end of a reusable hollow-ended hockey stick shaft.

BACKGROUND OF THE INVENTION

Sports sticks, such as ice and field hockey sticks, comprise a shaft for holding the stick and a blade at one end of the shaft. From their inception, these types of sticks have typically been constructed entirely of wood so as to be a unitary entity. Even today, many such sticks are constructed in this manner. With unitary construction type sticks, breaking of the blade necessitates replacement of the entire stick, including the shaft.

Recently, there have been developments with respect to two-piece stick construction where the shaft is reusable and the blade is removably mountable onto the shaft. By way of example only, such developments in hockey sticks include reusable shafts made from aluminum or various composite materials, which shafts are fitted with replaceable wooden, plastic, or composite construction blades.

One form of replacement blade for a reusable aluminum or composite shaft requires that hot melt glue be applied directly to the shank of the blade. The hot melt glue is heated up and melted at the time of fitting the shank into the shaft. When the glue has reset, it secures the blade to the shaft.

Although the above hot melt glue system does provide a very positive interlock between the shank of the blade and the shaft, there are a number of problems associated with it. It requires significant heating, which is inconvenient and undesirable, and it is time-consuming because it is difficult to force the blade onto the shaft as substantial force is required. Also, the shafts tend to crack because they are subjected to repeated heating and cooling and also because of the significant force required to mount the blade onto the shaft. Further, it is generally not possible to replace a blade during a hockey game, if a blade should break, but must be done later.

With such two-piece type hockey sticks where glue is used to help retain the blade in place on the shaft and also with conventional one-piece wooden hockey sticks, it is necessary, and indeed mandatory, in some hockey leagues, to have at least two, or preferably three, hockey sticks, at the start of each game. In the event that a player's hockey stick breaks, there is always a hockey stick in reserve. Owning three or more hockey sticks, however, can be prohibitively expensive, especially the two-piece type hockey sticks. Further, it is necessary to carefully select each shaft of a two-piece hockey stick or each conventional one-piece wooden hockey stick, in order to obtain a desired weight, size, balance, and so on, which is time consuming and undesirable.

PRIOR ART

Various mechanical systems have been developed for interlocking a hockey blade with a reusable aluminum shaft.

These systems include threaded interlocking components fitted completely through and exposed on opposite sides of the shank of the blade. The system is threadibly adjustable between a release and an interlock position.

Such mechanical interlock systems provide a somewhat effective interlock between the blade shank and the shaft; however, because a hole must be drilled completely through the shank for receiving the interlock system, the shank is substantially weakened, thus leading to potential delamination problems, which could result in premature breakage of the blade at the shank.

Another prior art system comprises a wooden hockey blade wherein the upper portion of the shank is reduced slightly and has soft plastic inserts adhered thereon, which inserts each have a plurality of downwardly angled teeth. These teeth provide friction for precluding the shank, and thus the blade, from sliding out of the hockey stick shaft.

U.S. Pat. No. 5,582,406 issued Dec. 10, 1996 to BABCOCK discloses a hockey stick blade coupler wherein a tapered wedge is secured to a co-operating tapered surface on the shank of a hockey stick blade by means of a elongate threaded fastener, so as to be adjustable in position. After the tapered wedge is installed in place, the hockey stick shaft is inserted over the shank of the blade and the tapered wedge. The threaded fastener is then turned through use of a special tool until the tapered wedge and the shank of the blade frictionally engage two of the walls of the hockey stick shaft. This hockey stick blade coupler has serious disadvantages associated with it. The hockey stick shaft does not need to be fully in place before the threaded fastener is tightened. Accordingly, the hockey stick shaft may be secured in place incorrectly and may be disposed only partially onto the shank of the blade. Further, using a special tool to secure the hockey stick shaft in place and remove it is inconvenient, and the special tool may not be available during a hockey game. Also, the threaded fastener might loosen slightly, thus causing a decrease in the frictional force applied by the tapered wedge and shank to the hockey stick shaft, thus increasing the chance that the hockey stick shaft and the blade could separate.

OBJECTS OF THE INVENTION

It is an object of the present invention to provide a hockey stick blade assembly for secure operative installation onto a reusable hollow-ended hockey stick shaft wherein the blade is quickly and easily installable and replaceable.

It is an object of the present invention to provide a hockey stick blade assembly for secure operative installation onto a reusable hollow-ended hockey stick shaft, wherein no heat is required for the installation of a blade onto a hockey stick shaft.

It is an object of the present invention to provide a hockey stick blade assembly for secure operative installation onto a reusable hollow-ended hockey stick shaft, wherein no adhesive is required for the installation of a blade onto a hockey stick shaft.

It is an object of the present invention to provide a hockey stick blade assembly for secure operative installation onto a reusable hollow-ended hockey stick shaft, wherein a substantial force is not required for the installation of a blade onto a hockey stick shaft.

It is an object of the present invention to provide a hockey stick blade assembly for secure operative installation onto a reusable hollow-ended hockey stick shaft wherein the end of the shaft is not weakened by installation of a blade thereon.

It is an object of the present invention to provide a hockey stick blade assembly for secure operative installation onto a reusable hollow-ended hockey stick shaft wherein a broken blade can be removed and a new blade installed "on-the-go", such as during a hockey game.

SUMMARY OF THE INVENTION

In accordance with one aspect of the present invention, there is provided a hockey stick blade assembly for removable and replaceable installation onto a reusable hockey stick shaft having a longitudinal axis and a hollow end defined by outer walls adjoined one to another and disposed in surrounding relation about the longitudinal axis. The hockey stick blade assembly comprises a blade member having a bottom blade portion and an upwardly extending hozel portion insertable into the hollow end of the hockey stick shaft, so as to be installable into and removable from the hockey stick shaft. First and second co-operating wedging surfaces are operatively disposed on the hozel portion of the blade member and on a wedge member, respectively, the first and second co-operating wedging surfaces being shaped for wedging contact with each other when the blade member is installed on the hockey stick shaft. When the hozel portion of the blade member engages the hockey stick shaft, the first wedging surface imparts a substantially transverse first wedging force to the second wedging surface and the second wedging surface imparts an oppositely directed substantially transverse second wedging force to the first wedging surface, which wedging forces are transmitted to the outer walls of the hollow-ended hockey stick shaft. The outer walls deform slightly to absorb the opposed first and second wedging forces and thus impart corresponding inwardly directed opposed reaction forces against the first and second wedging surfaces, thereby forcing the first and second wedging surfaces into intimate frictional engagement one with the other, so as to retain the blade member in place on the hockey stick shaft. A locking means is securely engageable between the blade member and the hockey stick shaft to preclude relative movement along a common longitudinal axis of the blade member and hockey stick shaft with respect to each other when the blade member is installed on the hockey stick shaft.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

Figure 1:
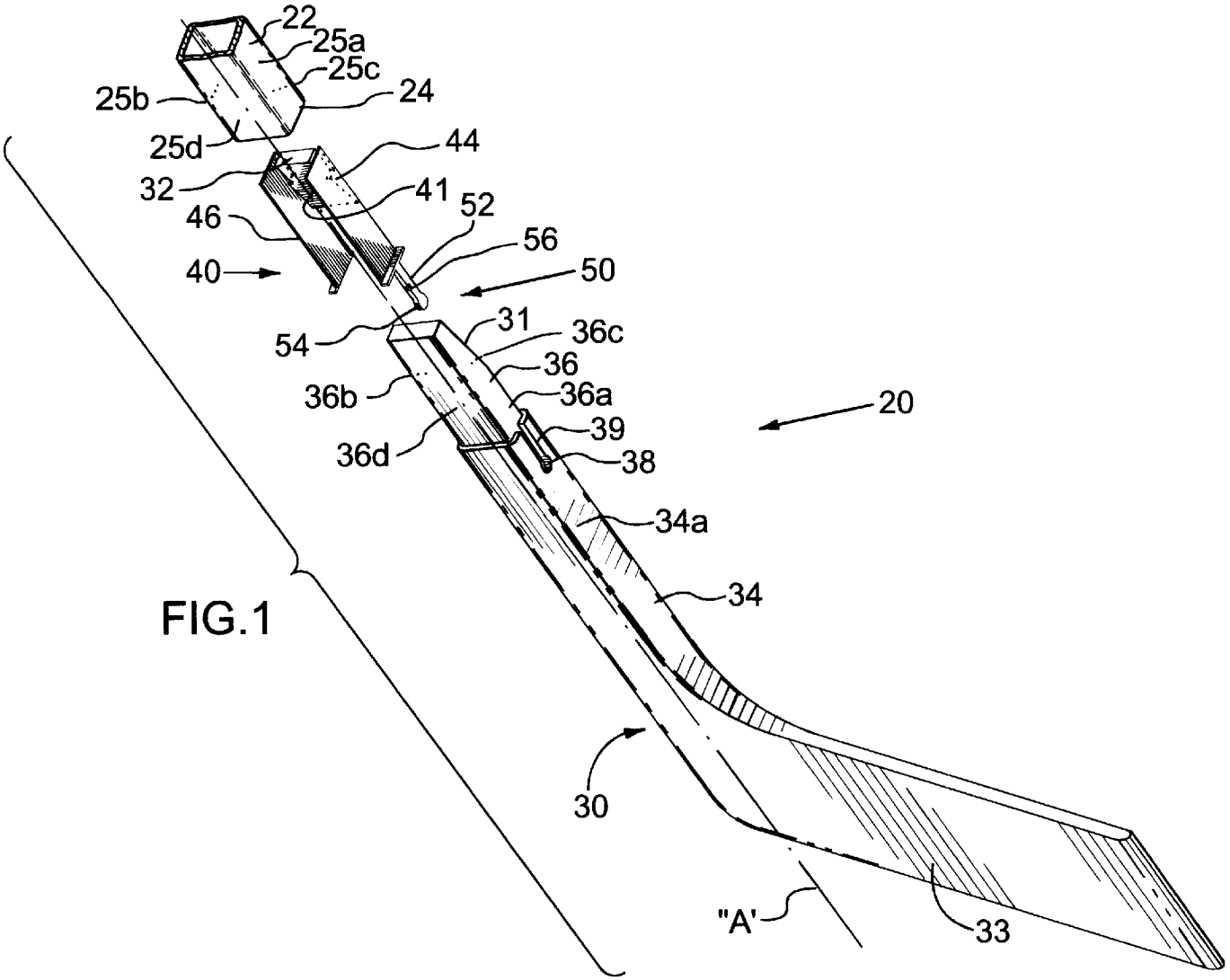
FIG. 1 is an exploded perspective view of a preferred embodiment of the hockey stick blade assembly according to the present invention.
Figure 2:
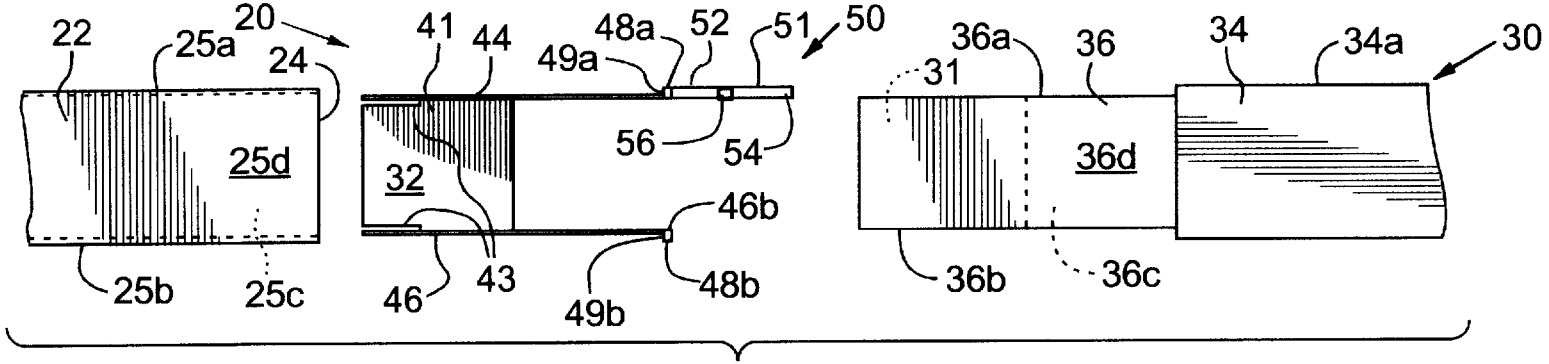
FIG. 2 is an exploded side elevational view of the hockey stick blade assembly of FIG. 1.
Figure 3:
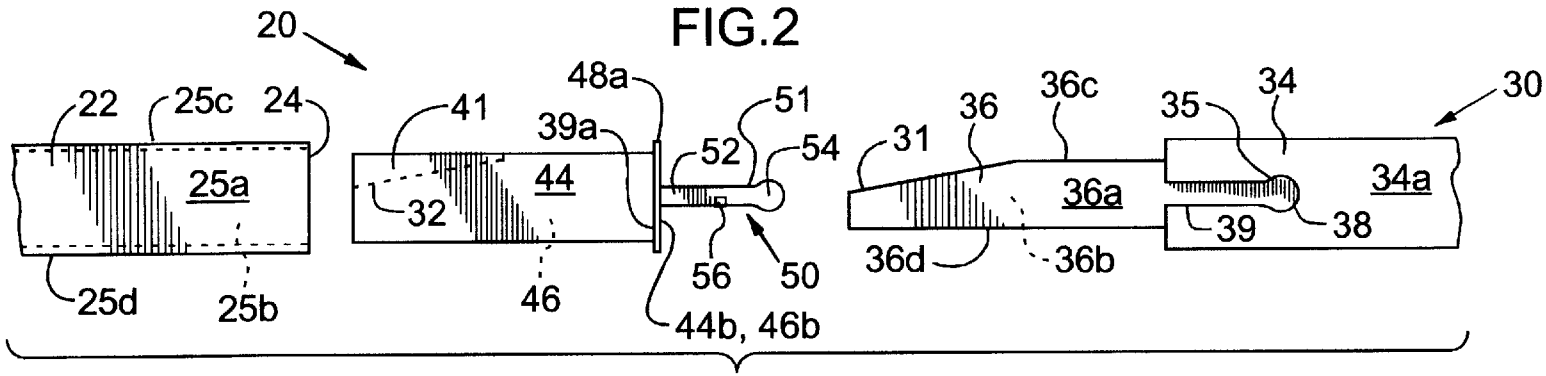
FIG. 3 is an exploded front elevational view of the hockey stick blade assembly of FIG. 1.

DETAILED DESCRIPTION OF THE PREFERRED EMBODIMENTS:

Reference will now be made to FIGS. 1 through 5, which show a preferred embodiment of the replaceable hockey stick blade assembly of the present invention, as indicated by the general reference numeral 20. The replaceable hockey stick blade assembly 20 is for removable and replaceable installation onto a reusable hollow-ended hockey stick shaft 22. The hockey stick shaft has a longitudinal axis "A" and a hollow end 24 defined by outer walls 25 (namely front outer wall 25*a*, rear outer wall 25*b*, and side outer walls 25*c*, 25*d*) adjoined one to another and disposed in surrounding relation about the longitudinal axis "A".

The replaceable hockey stick blade assembly 20 comprises a blade member, as indicated by the general reference numeral 30, which blade member 30 shares the common longitudinal axis "A", and includes a bottom ice-contacting blade portion 33, an upwardly extending shank portion 34, and an upwardly extending shaft fitting hozel portion 36, so as to be installable into and removable from the hockey stick shaft 22. For the purposes of this disclosure, in order to establish a frame of reference, the replaceable hockey stick blade assembly 20 will be referred to as if it is in an upright playing position—that is to say with the bottom ice-contacting blade portion 33 on the ice and the hockey stick shaft 22 extending upwardly, but not necessarily vertically, from the bottom ice-contacting blade portion 33.

Preferably, the blade portion 33 and the hozel portion 36 are wooden and are integrally formed one with the other, preferably of a laminated construction, for purposes of strength. Other suitable materials may also be used, such as plastic, among others. In the preferred embodiment, as shown, the hozel portion 36 is substantially rectangular in cross-section, having a front surface 36*a* and a rear surface 36*b* interconnected by opposed first and second side surfaces 36*c*, 36*d*. A first co-operating wedging surface 31 is operatively disposed on the hozel portion of the blade member. In the preferred embodiment, the first wedging surface 31 is disposed on the first side surface 36*c* and alternatively may be otherwise disposed on any one of the front surface 36*a*, the rear surface 36*b*, and the second side surface 36*d*. The second side surface 36*d*, which is disposed opposite to the first wedging surface 31, the front surface 36*a*, and the rear surface 36*b* are substantially planar for intimate contact with the interior surface 25*a*, 25*b*, 25*c*, 25*d* of the reusable hollow-ended hockey stick shaft 22.

A second co-operating substantially planar wedging surface 32 is operatively disposed wedge member. The first and second co-operating wedging surfaces 31,32 are shaped for wedging contact with each other when the blade member 30 is installed onto the hockey stick shaft 22. In the preferred embodiment, the second co-operating wedging surface 32 is disposed on a separate wedge member 41 that frictionally engages one of the outer walls 25 of the hockey stick shaft 22 when the blade member 30 is installed onto the hockey stick shaft 22. In this manner, the separate wedge member 41 is removable and replaceable with the blade member 30, which is convenient in the event that the separate wedge member 41 breaks, or in order to accommodate various types of blades and hozels.

Figure 5:
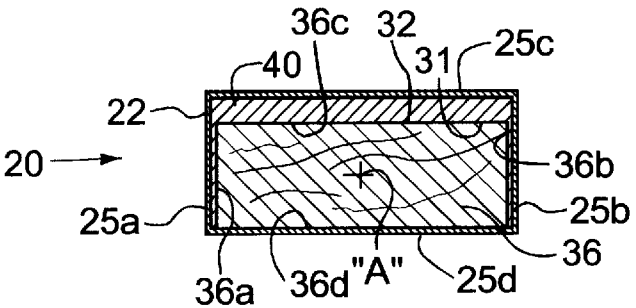
FIG. 5 is a cross-sectional view of the hockey stick blade assembly of FIG. 1, taken along section line 5—5 of FIG. 4.
Figure 4:
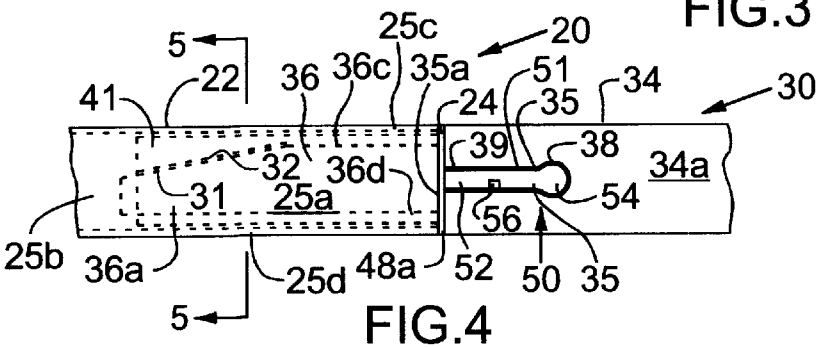
FIG. 4 is an enlarged front elevational view of a portion of the hockey stick blade assembly of FIG. 1.

As can best be seen in FIGS. 4 and 5, the wedge member 41 is adapted to securely fit in wedging relation between the first wedging surface 31 of the hozel portion 36 of the blade member 30 and an interior surface of the reusable hollow-ended hockey stick shaft 22, with the wedge member 41 frictionally engaging one of the interior surfaces 25*c*, 25*d* of the two side outer walls 25*c*, 25*d* of the hockey stick shaft 22, when the blade member 30 is securely operatively installed at the hollow end 24 of the reusable hollow-ended hockey stick shaft 22.

When the blade member 30 is installed on the hockey stick shaft 22, such that the hozel portion 36 of the blade member 30 engages the outer walls 25 of the hockey stick shaft 22, the first wedging surface 41 imparts a substantially transverse first wedging force to the second wedging surface 42 and the second wedging surface 42 imparts an oppositely directed substantially transverse second wedging force to the first wedging surface 41. The opposed first and second wedging forces are ultimately transmitted to the outer walls 25 of the hollow-ended hockey stick shaft 22, and accordingly the outer walls 25 deform slightly to absorb the opposed first and second wedging forces. The outer walls 25 thus impart corresponding inwardly directed opposed reaction forces against the first and second wedging surfaces 31,32, thereby forcing the first and second wedging surfaces 31,32 into intimate frictional engagement one with the other, so as to retain the blade member 30 in place on the hockey stick shaft 22.

The wedge member 41 includes first and second opposed substantially parallel flanges 44,46, and stop lips 48*a*, 48*b* disposed adjacent the bottom ends 44*b*, 46*b* of the substantially parallel flanges 44,46. Also included on the separate wedge member 41 is at least one shaft abutment surface. There are two shaft abutment surfaces 49*a*, 49*b* disposed one on each of the parallel flanges 44,46 so as to abut against an end portion 23 of the hockey stick shaft 22 when the wedge member 41 is in place in the hockey stick shaft 22.

The first and second opposed substantially parallel flanges 44,46 extend outwardly from the wedge member 41, so as to be disposed substantially perpendicularly to the hozel-contacting surface of the wedge member 41, and are positioned, shaped, and dimensioned to engage the front and rear surfaces 36*a*, 36*b*, respectively, of the hozel portion 36 of the blade member 30. The first and second opposed substantially parallel flanges 44,46 help retain the wedge member 41 in correct placement on the hozel portion 36.

A pair of slots 43 is disposed in the wedge member 41, one slot 43 adjacent each of the parallel flanges 44,46. The wedge member 41 and the parallel flanges 44,46 are thereby deformable with respect to one another, inwardly towards the generally centrally disposed longitudinal axis "A", so as to facilitate entry of the wedge member 41, including the first and second opposed substantially parallel flanges 44,46, and the hozel portion 36 of the blade member 30 into the hollow end 24 of the reusable hollow-ended hockey stick shaft 22.

The wedge member 41 and the blade member 30 are precluded from unwantedly moving one relative to the other along the centrally disposed longitudinal axis "A", when the blade member is installed onto the hockey stick shaft, by means of a locking means, as indicated by the general reference numeral 50, which locking means 50 is securely engageable between the blade member 30 and the hockey stick shaft 22. The locking means 50 precludes relative movement along the common longitudinal axis "A" of the blade member 30 and the hockey stick shaft 22 with respect to each other when the blade member 30 is installed onto the hockey stick shaft 22, as will be discussed in greater detail subsequently.

The locking means 50 preferably comprises a locking member 51 that is integrally formed with the wedge member 41, but is at least securely connected thereto. In the preferred embodiment as illustrated, the locking member 51 comprises a tether arm portion 52 generally extending downwardly from the bottom end 44*b* of the first flange 44, and oriented substantially along the generally centrally disposed longitudinal axis "A" toward the blade portion 33 for a distance of about two cm to about three cm, so as to be disposed over the shank portion 34 of the blade member 30. Alternatively, the tether arm portion 52 may extend downwardly from the second flange 46, or two tether arm portions 52 may be employed one extending downwardly from each of the first and second opposed substantially parallel flanges 44,46.

The tether arm portion 52 preferably extends downwardly from the first flange 44 so as to be disposed in a channel 39 in the front surface 34*a* of the shank portion 34, thus being readily visible and accessible. The tether arm portion 52 terminates in an enlarged portion 54 and is movable between a locking position whereat the enlarged portion 54 abuts against a cooperating substantially downwardly facing receiving surface 35 on the blade member 30, and a non-locking position whereat the enlarged portion 54 is removed from abutment against the co-operating substantially downwardly facing receiving surface 35 on the blade member 30.

The substantially downwardly facing receiving surface 35 is part of a recessed socket 38 formed in the front surface 34*a* of the shank portion 34 at the end of a channel 39. The channel 39 is shaped and dimensioned to receive the tether arm portion 52 therein and the socket 38 is shaped and dimensioned to receive the enlarged portion 54. Alternatively, the socket 38 may be disposed in the rear surface 34*b* of the shank portion 34, depending on the positioning of the tether arm portion 52.

It can be seen that the enlarged portion 54 is disk shaped, but also may be of any other suitable shape. For instance, a straight elongate shape could be used to provide an increased area of contact with a co-operatively shaped downwardly facing receiving surface.

As discussed above, the locking member 51 is selectively movable, by way of bending of the tether arm portion 52 between a locking position and a non-locking position. When the tether arm portion 52 is in its locking position, the tether arm portion 52 assumes the natural rest configuration of the plastic material. Accordingly, the tether arm portion 52 remains in its locking position until purposefully moved to its non-locking position. In the locking position, the enlarged portion 54 is received in the socket 38 so as to abut against the cooperating substantially downwardly facing receiving surface 35, thus precluding the blade member 30 and the wedge member 41 from moving with respect to each other, along the centrally disposed longitudinal axis "A", and thus retaining the blade member 30 in its in-use position. In this manner, the wedge member 41 is precluded from being unwantedly removed from the aforesaid wedging relation between the hozel portion 36 and the interior surface of the reusable hollow-ended hockey stick shaft 22. Accordingly, the blade member 30 is precluded from becoming unwantedly removed from secure operative installation in its aforesaid in-use position on the reusable hollow-ended hockey stick shaft 22.

In the non-locking position, the tether arm portion 52 is removed from its abutment against the co-operating substantially downwardly facing receiving surface 35, and the blade member 30 and the wedge member 41 are allowed to move with respect to each other, along the centrally disposed longitudinal axis "A", thus permitting the blade member 30 to be removed from its in-use position.

In the preferred embodiment, the tether arm portion 52 of the locking member 50 includes a reduced portion 56 that conduces plastic deformation of the tether arm portion 52 upon movement of the tether arm portion 52 from its locking position to its non-locking position. In this manner, after a broken blade member 30 has been removed, the wedge member 41 cannot be reused unless the tether arm portion 52 is temporarily secured into place by separate means such as hockey tape or the like. Instead, the reduced portion 56 helps to ensure that a new wedge member 41 will be used each time a blade is replaced. This is advantageous in that it ensures that the plastic wedge member 41 is relatively new and therefore is not cracked or otherwise fatigued, thus minimizing the chances of unwanted breakage of the plastic wedge member 41 during use.

Figure 6:
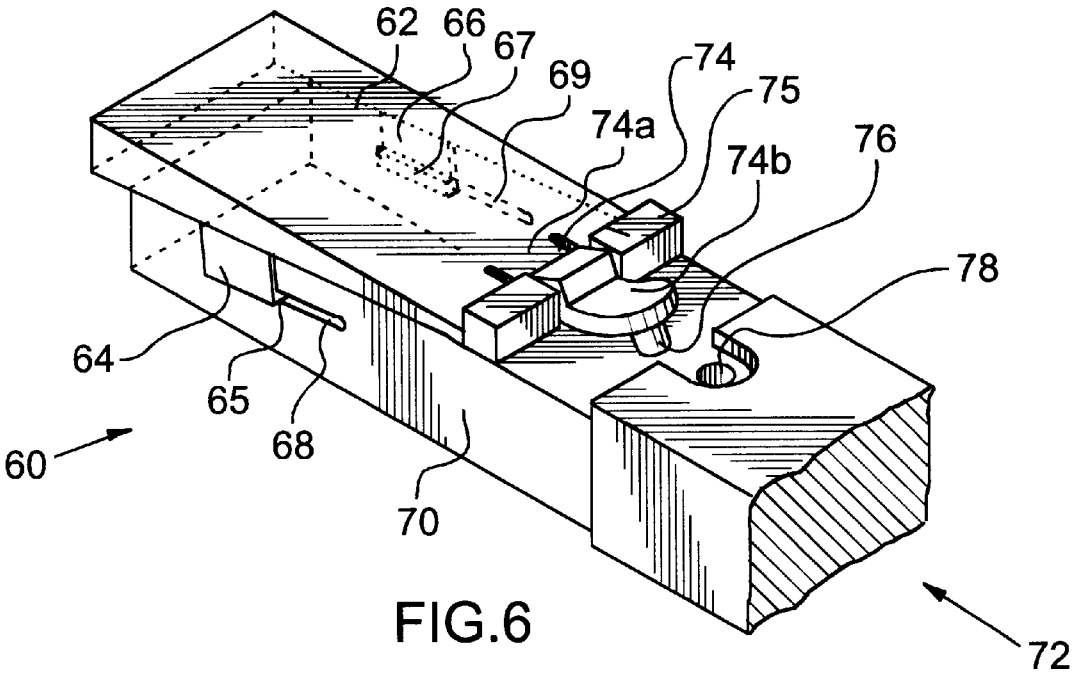
FIG. 6 is a perspective view of a first alternative embodiment of the hockey stick blade assembly according to the present invention.
Figure 7:
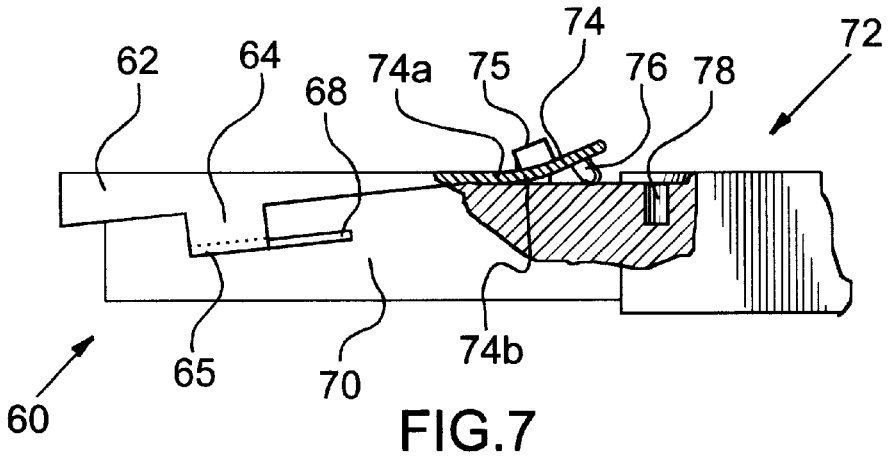
FIG. 7 is a side elevational view of the first alternative embodiment of the hockey stick blade assembly of FIG. 6.

Reference will now be made to FIGS. 6 and 7, which show an alternative embodiment of the replaceable hockey stick blade assembly 60 of the present invention. A wedge member 62 has first and second opposed substantially parallel flanges 64, 66, which flanges 64, 66 are substantially smaller than in the preferred embodiment. Further, the first and second opposed substantially parallel flanges 64, 66 have respective ridges 65, 67 thereon, which ridges 65, 67 engage in sliding relation respective tracks 68, 69 in the hozel portion 70 of the blade member 72. The tether arm portion 74 has an upper arm portion 74*a* formed as part of the wedge member 62, and a lower portion 74*b* that extends a short distance downwardly therefrom. The upper portion 74*a* and the lower portion 74*b* are separated one from the other by a stop lip 75. A pin member 76 projects from the lower portion 74*b* of the tether arm portion 74, which pin member 76 is shaped and dimensioned to engage a receiving aperture 78 in the blade member 72.

Figure 8:
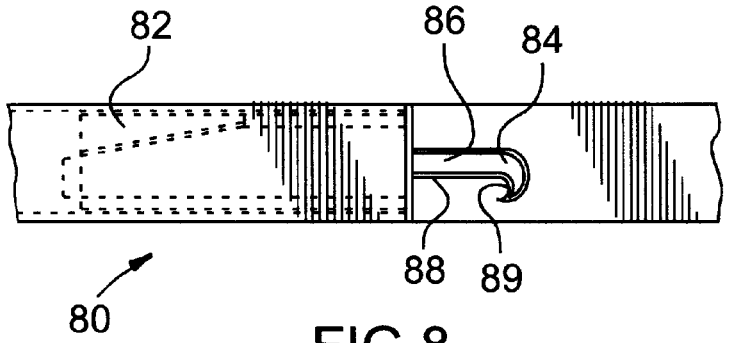
FIG. 8 is a front elevational view of a second alternative embodiment of the hockey stick blade assembly according to the present invention.

In a second alternative embodiment of the present invention, as can be seen in FIG. 8, the replaceable hockey stick blade assembly 80 has a wedge member 82 with a locking member 84 configured differently than in the preferred embodiment shown in FIGS. 1 through 5. The tether arm portion 86 of the locking member 84 is substantially hook shaped. The channel 88 is co-operatingly shaped and has a downwardly facing receiving surface 89 formed therein. In use, the hook shaped tether arm portion 86 abuts against the downwardly facing receiving surface 89 of the co-operatingly shaped channel 88.

Figure 9:
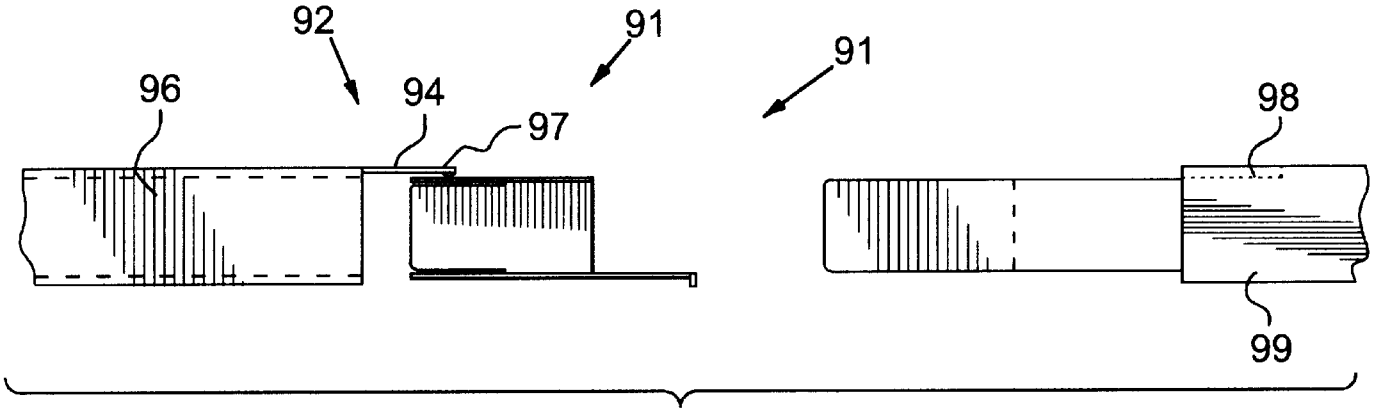
FIG. 9 is a side elevational view of a third alternative embodiment of the hockey stick blade assembly according to the present invention.

In a third alternative embodiment of the present invention, as can be seen in FIG. 9, the replaceable hockey stick blade assembly 90 has a locking means 91 that comprises a locking member 92 having a tether arm portion 94 secured to the hockey stick shaft 96 and extending downwardly therefrom. The tether arm portion 94 terminates in an enlarged portion 97 that abuts against a co-operating substantially downwardly facing receiving surface 98 on the blade member 99, when the locking member 92 is in its locking position.

Figure 10:
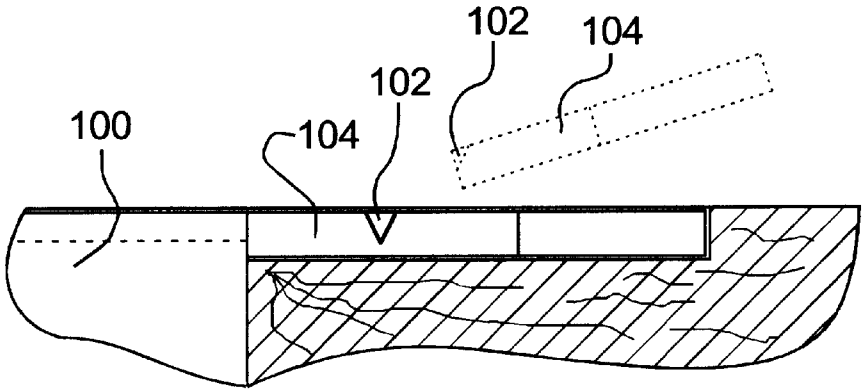
FIG. 10 is an enlarged side elevational view of a fourth alternative embodiment of a portion of the hockey stick blade assembly according to the present invention, with a portion of the blade member shown in cross-section.

In a fourth alternative embodiment of the present invention, as illustrated in FIG. 10, the wedge member 100 includes a readily frangible reduced portion 102 that conduces fracture of the tether arm portion 104, as is illustrated in ghost outline, upon movement of the tether arm portion 104 from its locking position to its non-locking position.

In a fifth alternative embodiment of the present invention, as can be seen in FIGS. 11 and 12, the replaceable hockey stick blade assembly 110 has a wedge member 112 that is an integral part of a hockey stick shaft 114. Typically the hockey stick shaft 114 is extruded and the wedge member 112 is installed in place during a subsequent manufacturing operation. The hockey stick blade assembly 110 has a locking means that comprises a threaded fastener 116 that engages a co-operating countersunk aperture 118 in the hockey stick shaft 114 and threadibly engages a co-operating bore hole 120 in the hozel portion 122 of the blade member 124.

In a further alternative embodiment (not shown), it is contemplated that the locking means used comprises a separate locking member with two enlarged portions disposed one enlarged portion at each end of the separate locking member, which enlarged portions each frictionally engage a co-operating receiving orifice.

In yet another alternative embodiment (not shown), it is contemplated that the first wedging surface and the second wedging surface could be oriented substantially oppositely to the orientations disclosed in the preferred embodiment as shown, such that the first and second wedging surfaces the aforediscussed wedging forces when the hockey stick shaft is pulled upwardly from the blade member. In this manner, the natural tendency of the hockey stick shaft and blade member to separate one from the other would cause increased wedging, thus retaining the blade member more securely on the hockey stick shaft.

It can readily be seen that the replaceable hockey blade assembly of the present invention has many advantages over the prior art. The blade member is quickly and easily replaceable, even during a hockey game, thus permitting a player to have available during a hockey game only one reusable shaft and three or more blade members, which is significantly less expensive than owning three complete two-piece hockey sticks. Further, a player does not have to find more than one shaft that has an ideal weight, size, balance, and so on.

Other modifications and alterations may be used in the design and manufacture of the apparatus of the present invention without departing from the spirit and scope of the accompanying claims.

What is claimed is:

1. A hockey sticking blade assembly for removable and replaceable installation onto a reusable hockey stick shaft having a longitudinal axis and a hollow end defined by outer walls adjoined one to another and disposed in surrounding relation about said longitudinal axis, said hockey stick blade assembly comprising:

a blade member having a bottom blade portion and an upwardly extending hozel portion that is substantially rectangular in cross-section and has a front surface and a rear surface interconnected by opposed first and second side surfaces said hozel portion being insertable into a hollow end of a hockey stick shaft, so as to be installable into and removable from a hockey stick shaft;

first and second substantially planar co-operating wedging surfaces operatively disposed on said hozel portion of said blade member and on, respectively, said first and a second co-operating wedging surfaces being shaped for wedging contact with each other when said blade member is installed onto a hockey stick shaft;

wherein said first wedging surface is disposed on one of said front, rear, first side and second side surfaces of said hozel portion of said blade member and the other three of said front, rear, first side and second side surfaces are substantially planar;

wherein said wedge member is a removable and replaceable separate wedge member that frictionally engages an outer wall of a hockey stick shaft when said blade member is installed onto a hockey stick shaft;

wherein, when said hozel portion of said blade member engages a hockey stick shaft, said first wedging surface imparts a substantially transverse first wedging force to said second wedging surface and said second wedging surface imparts an oppositely directed substantially transverse second wedging force to said first wedging surface, which wedging forces are adopted to be transmitted to the outer walls of a hollow-ended hockey stick shaft, and wherein the outer walls deform slightly to absorb said opposed first and second wedging forces and thus impart correspondingly inwardly directed opposed reaction forces against said first and second wedging surfaces, thereby forcing said first and second wedging surfaces into intimate frictional engagement one with the other, so as to retain said blade member in place on a hockey stick shaft;

at least one shaft abutment surface disposed on said separate wedge member;

first and second opposed substantially parallel flanges extending outwardly from said wedge member in transverse bordering relation to said second wedging surface, and being positioned, shaped, and dimensioned to engage said front and rear surfaces, respectively of said hozel portion; and, locking means securely engageable between said blade member and said wedge member to preclude relative movement along a common longitudinal axis of the blade member and hockey stick shaft with respect to each other when said blade member is installed onto a hockey stick shaft.

2. The hockey stick blade assembly of claim 1, wherein said at least one shaft abutment surface is disposed on one of said parallel flanges so as to abut against an end portion of a hockey stick shaft when said wedge member is in place in a hockey stick shaft.

3. The hockey stick blade assembly of claim 2, further comprising a pair of slots disposed in said wedge member, one slot adjacent each of said parallel flanges, wherein said wedge member and said parallel flanges are thereby deformable with respect to one another, inwardly towards a generally centrally disposed longitudinal axis, so as to be adopted to facilitate entry of said wedge member and said hozel portion into said hollow end of a reusable hollow-ended hockey stick shaft.

4. The hockey stick blade assembly of claim 3, wherein said locking means comprises a locking member integrally formed with said wedge member.

5. The hockey stick blade assembly of claim 4, wherein said locking member comprises a tether arm portion extending downwardly from a bottom end of one of said first and second flanges and terminating in an enlarged portion, which tether arm portion is movable between a locking position whereat said locking member abuts against a co-operating substantially downwardly facing receiving surface on said blade member, and a non-locking position whereat said locking member is removed from abutment against said co-operating substantially downwardly facing receiving surface on said blade member.

6. The hockey stick blade assembly of claim 5, wherein said receiving surface on said blade member forms part of a recessed socket.

7. The hockey stick blade assembly of claim 6, wherein said tether arm portion includes a reduced portion that conduces plastic deformation of said tether arm upon movement of said locking member from its locking position.

8. The hockey stick blade assembly of claim 7, wherein said tether arm portion includes a readily frangible reduced portion that conduces fracture of said tether arm upon movement of said locking member from said locking position.

9. The hockey stick blade assembly of claim 1, wherein said separate wedge member is plastic.

* * * * *